US005335853A

United States Patent [19]

Wirz

[11] Patent Number: 5,335,853

[45] Date of Patent: Aug. 9, 1994

[54] COMPACT LONG-LASTING SPRAYER, PUMP AND AGITATOR COMBINATION

[76] Inventor: Pedro Wirz, Panamericana 445, Lagos de Moreno, C.P. 47400, Jalisco, Mexico

[21] Appl. No.: 916,942

[22] Filed: Jul. 20, 1992

[30] Foreign Application Priority Data

Mar. 27, 1992 [MX] Mexico ..... 92 01368

[51] Int. Cl.[5] ..... B05B 9/04; B05B 9/08

[52] U.S. Cl. ..... 239/142; 239/154; 239/333; 222/385; 366/136; 417/437

[58] Field of Search ..... 239/142, 152, 154, 127, 239/333, 373; 417/234, 430, 437; 366/136, 137, 159; 222/401, 383-385

[56] References Cited

U.S. PATENT DOCUMENTS

| | | | |
|---|---|---|---|
| 862,867 | 8/1907 | Eggleston | 417/390 |
| 2,768,581 | 10/1956 | Langemack | 103/38 |
| 3,399,639 | 9/1968 | Enblom | 239/333 |
| 4,690,331 | 9/1987 | Luchsinger | 239/333 |
| 4,702,416 | 10/1987 | Pagliai et al. | 239/11 |
| 4,702,419 | 10/1987 | Luchsinger | 239/333 |
| 4,768,714 | 9/1988 | Luchsinger | 239/142 |
| 4,798,333 | 1/1989 | Luchsinger | 239/142 |

*Primary Examiner*—Karen B. Merritt
*Attorney, Agent, or Firm*—Richard L. Gausewitz

[57] ABSTRACT

A backpack spray apparatus for applying insecticides and fertilizers comprises a large tank in which is mounted a pressure vessel. A pumping assembly is connected with the bottom portion of the pressure vessel and also with the bottom portion of the container tank. It consists of a double-acting piston assembly, a valve, and passages to connect a portion of the cylinder chamber above the piston assembly to the pressure vessel and to the container tank, so that upon reciprocation of the piston there is pumping of liquid from the container tank to the pressure vessel. There is also a connection between the portion of the cylinder chamber below the piston assembly and the lower portion of the container tank, so that upon reciprocation of the piston assembly there is pumping of the liquid back and forth. An operator-actuated handle reciprocates the piston assembly. There is no diaphragm associated with the pumping assembly—all pumping being done by the pumping assembly. Any liquid that leaks from the piston assembly does not drop onto the operator or the earth but instead joins liquid being pumped back and forth as above indicated.

9 Claims, 2 Drawing Sheets

2

COMPACT LONG-LASTING SPRAYER, PUMP AND AGITATOR COMBINATION

BACKGROUND OF THE INVENTION

Various United States patents have been obtained for hand-operated backpack-type sprayer combinations adapted to spray insecticides, fertilizers, fungicides, etc. These include: U.S. Pat. Nos. 4,690,331, 4,702,416, 4,702,419, 4,768,714, and 4,798,333. The constructions shown and described in the specified patents include relatively large-diameter diaphragms, and these are often combined with pistons in such manner that the diaphragm-piston combinations effect not only pumping of the liquid but also agitation of the liquid in the bottom of the back-carried container.

The diaphragms taught by the above-specified patents are relatively large in diameter and are often employed in combination with relatively large-diameter nuts. Thus, there are size and expense requirements that are not fully satisfied by the indicated prior-art constructions.

Another important consideration is that it is desirable to achieve even greater protection against eventual leakage than is afforded by the indicated prior-art construction. Diaphragms are very good sealing elements against leakage. However, after long-continued use in association with certain types of chemicals, even the best diaphragms may eventually crack. Upon occurrence of such an event, the insecticide or fertilizer would tend to leak out the bottom of the structure and may contact the operator, or may contact some location where the presence of the liquid is not desired.

SUMMARY OF THE INVENTION

In accordance with the present invention, there is provided a compact, strong, long-lasting sprayer combination having only a piston pump, and having no diaphragm, yet which not only effectively pressurizes the pressure vessel in the liquid container but also recirculates liquid back-and-forth between the pump and the bottom portion of the liquid container, thereby agitating such bottom portion so as to keep the liquid in mixed condition.

The present invention also provides a no-diaphragm double-acting piston pump for container pressurization and for liquid agitation, in combination with a slide bearing and a manually-operated actuating element.

The present invention also provides a double-acting piston and other elements in combination with a sealing gasket assembly, there being a port in the sealing gasket through which liquid circulates in both directions between the lower end of the cylinder for the double piston, and the bottom portion of the liquid container. In the event of leakage past the piston, the leaked liquid circulates to the liquid container.

DETAILED DESCRIPTION OF THE PREFERRED EMBODIMENT

Figure 1:
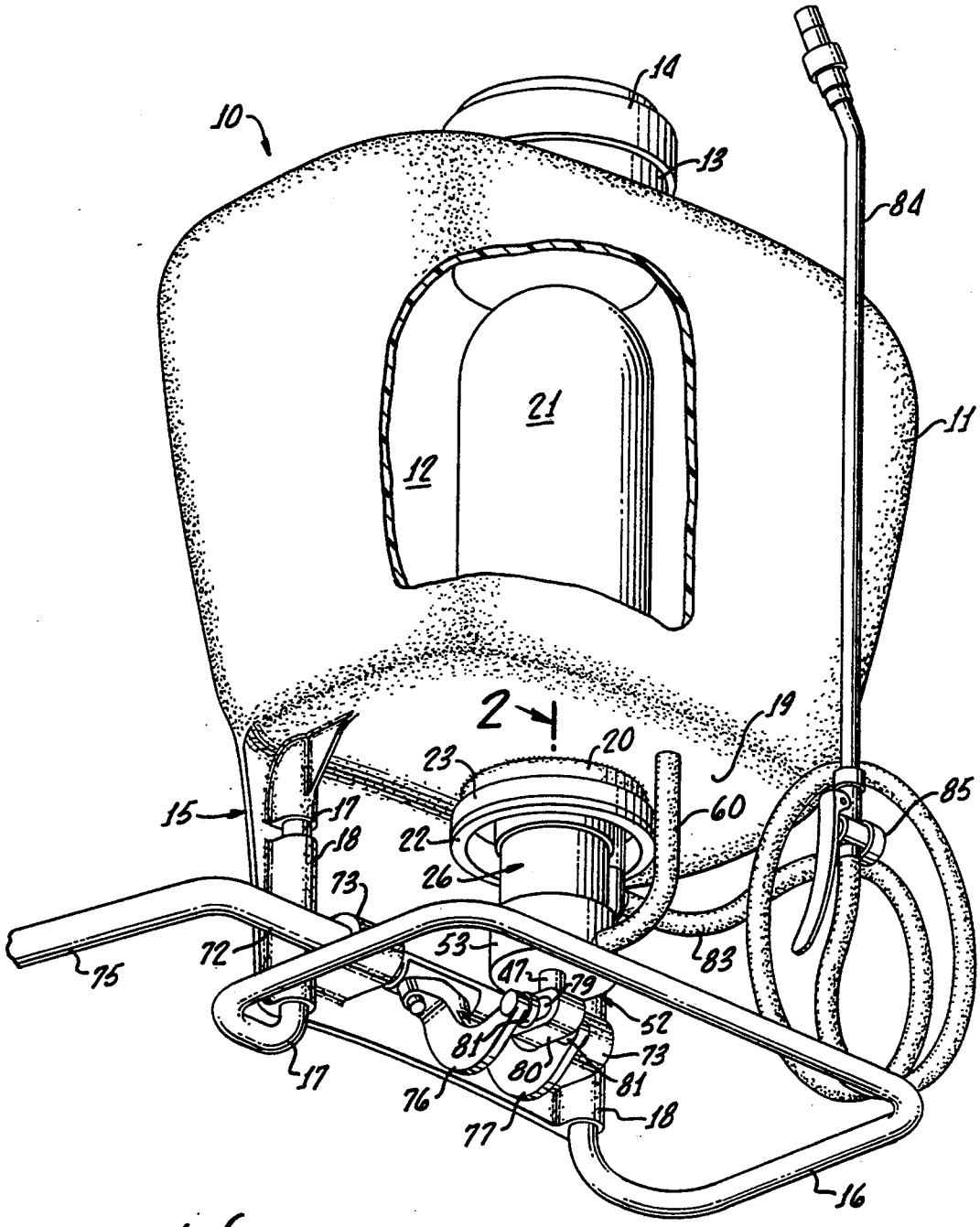
FIG. 1 is an isometric view of the combination of the invention, a portion of the wall of the liquid container being broken away in order to illustrate the pressure vessel.

Referring to the drawings, the illustrated apparatus comprises a liquid container 10 formed of synthetic resin, the body 11 of container 10 having a substantially flat back (not shown) adapted to rest against the back of the operator carrying and operating the pump-sprayer-agitator combination. The liquid chamber 12 within body 11 is adapted to be filled through a large fill opening defined by a neck 13, the fill opening being adapted to be sealingly closed by a screw-type cap 14.

The bottom-rear portion of container body 11 is molded integrally with a support and mounting portion 15 the back of which is substantially co-planar with the back side of body 11 so that the entire synthetic resin structure may rest against the back of the operator. Formed integrally at the upper-rear portion of body 11 are strong apertured regions, not shown, adapted to support shoulder straps, not shown, that extend over the shoulders and then downwardly for securing to a generally rectangular supporting frame 16 that is disposed in a generally horizontal plane. End regions of supporting frame 16 are bent upwardly to form legs 17 that are anchored fixedly in vertical bosses 18 of support and mounting portion 15.

Figure 2:
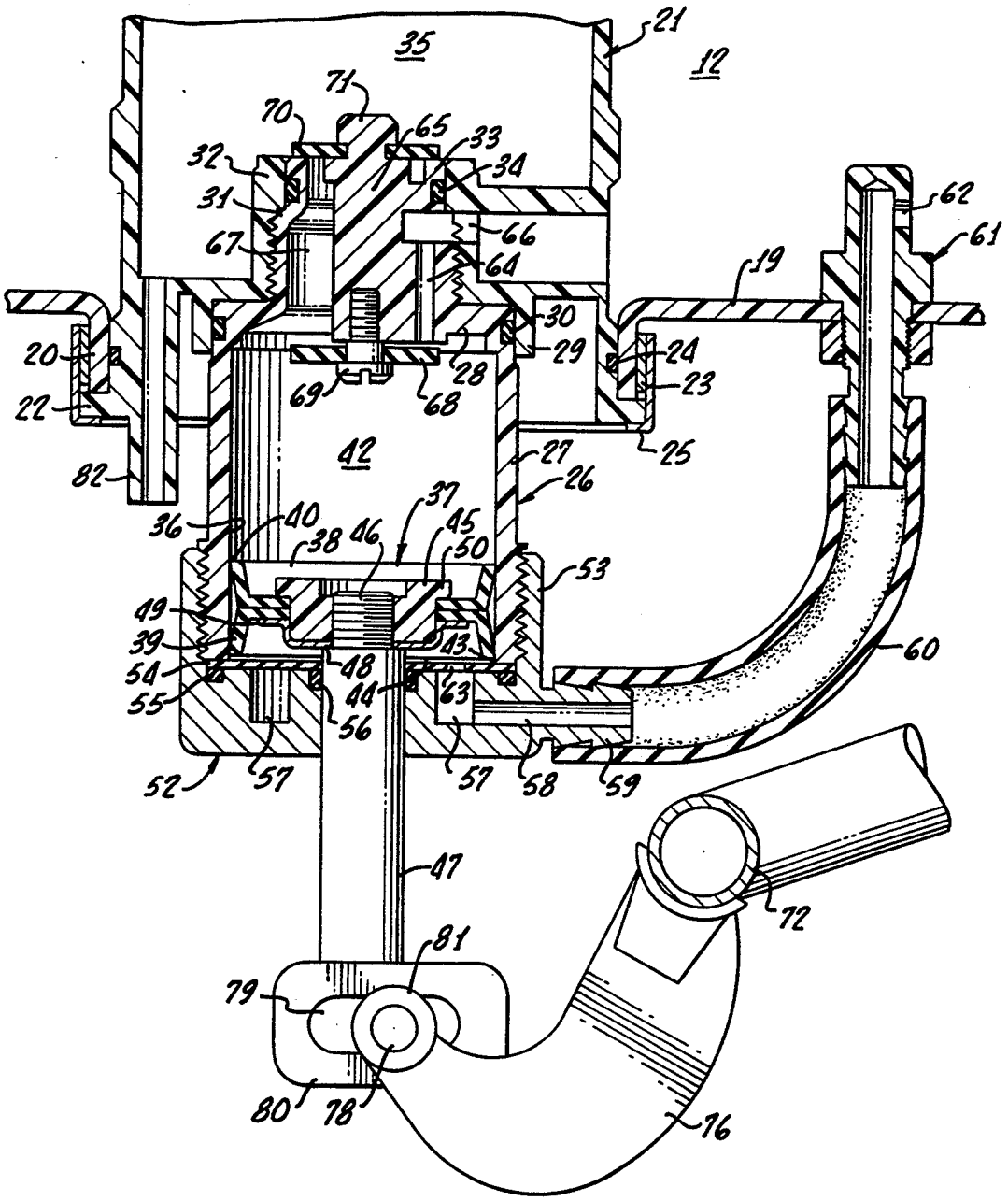
FIG. 2 is an enlarged vertical sectional view of the lower portion of the present combination, the section being taken generally on line 2—2 of FIG. 1.

Referring next to FIG. 2 as well as FIG. 1, the bottom wall 19 of container body 11 is generally horizontal, and has formed therein a relatively large opening that is defined by a downwardly-bent cylindrical flange portion 20 of wall 19.

A vertically elongate synthetic resin pressure vessel 21 is inserted upwardly through the opening defined by flange 20, and extends to the upper region of chamber 12 within the container body. Pressure vessel 21 is a strong component adapted to withstand pressures created therein by operation of the pump means described below.

A strong sealing connection is made between flange 20 and the lower end of pressure vessel 21, the latter end being exteriorly cylindrical and fitting closely against the interior cylindrical surface of flange 20. In addition, a radial end flange 22 is provided integrally on the lower end of the pressure vessel and seats against the bottom of flange 20.

A metal clamp 23, in the form of a large hose clamp, is mounted around flange 20 and tightened so as to effect strong pressure engagement between such flange and the pressure vessel 21. In addition, to enhance sealing, an O-ring 24 is preferably provided in an annular groove that is formed in the exterior portion of the pressure vessel. Circumferentially-spaced lugs 25 (shown in FIG. 2) are provided on clamp 23 and extend downwardly around end flange 22, so as to cooperate with the clamp 23 in assuring that the pressure vessel 21 does not move downwardly relative to its associated flange 22.

The No-Diaphragm Pumping and Agitating Mechanism

The pumping and agitating mechanism comprises a strong cylindrical synthetic resin body 26 that is closed at its upper end except for passage means described subsequently. A relatively large-diameter portion 27 of body 26 extends upwardly to a radial wall 28, the latter seating in an inverted cup-shaped recess formed in the bottom wall of pressure vessel 21. Such recess is defined in part by a cylindrical flange 29 that snugly receives the peripheral portion of wall 28, there being an O-ring 30 provided to insure against leakage from chamber 12 within the liquid container body 11.

A neck portion 31 on the upper side of wall 28 is exteriorly threaded and threadedly associated with interior threads of an internal upwardly-extending boss portion 32 of the pressure vessel 21. At the upper end of neck portion 31 is a head 33 that seats sealingly against an internal flange at the extreme upper portion of boss 32, there being an O-ring 34 provided to prevent leakage from the pressure chamber 35 within pressure vessel 21.

The internal surface 36 of the larger diameter portion 27 of body 26 is smooth, so that portion 27 acts as a cylinder for a double-acting piston assembly 37 that performs both pumping and agitating functions. The cylinder has upper and lower cylinder chambers as described below.

The piston assembly 37 comprises two back-to-back fustoconical cups 38,39 formed of a suitable flexible and preferably resilient sealing (not porous) material. The upper cup, number 38, has a sealing edge 40 that is held against wall 36 by the resilience of the cup and by the pressure within upper cylinder chamber 42. The other cup, number 39, is below cup 38, having an edge 43 that is held sealingly against cylinder wall 36.

When the double-acting piston assembly 37 moves upwardly, pressure in upper cylinder chamber 42 is increased and upper edge 40 is held more tightly against wall 36. On the other hand, the same upward movement reduces the pressure in a lower cylinder chamber 44 that is defined within cylinder body portion 27 below the lower piston cup 39. Despite this reduced pressure, there is no substantial tendency for flow past edges 40,43 in a downward direction from cylinder chamber 42, because of the above-stated close pressing of upper edge 40 against wall 36.

When the piston assembly 37 moves downwardly, pressure in upper cylinder chamber 42 is reduced but that in lower cylinder chamber 44 is increased, so that the combined action of edges 40,43 prevents leakage past the double piston.

The double-acting piston assembly 37 further includes a substantially solid centering and mounting element 45 that extends through large registered holes in the bottoms of the piston cups. Element 45 has an internally threaded apertured bottom wall that is threadedly associated with a threaded upper portion 46 of a vertical piston rod 47, there being a radial horizontal shoulder at the junction between portions 46,47. Seated between centering element 45 and the indicated shoulder is the central region of a thin-walled cup 48 having a horizontal radial flange 49. Such radial flange seats below and adjacent the horizontal wall of lower piston cup 39. Correspondingly, there is a radial flange 50 at the upper region of centering element 45, and this seats over a central region of the horizontal wall of upper cup 38.

Flange 49 has a diameter substantially larger than that of flange 50, so that the peripheral region of lower cup 39 is more closely supported than is the peripheral region of upper cup 38. However, the upper cup 38 is backed by more fluid pressure than is the lower cup, which fluid pressure acts outwardly against edge 40 as indicated above.

The pumping and agitation assembly further comprises a strong bottom cap 52. It has a cylindrical upper portion 53 that is threadedly associated with threads at the lower end of element 27. A disc-shaped gasket 54 extends across the entire lower wall of bottom cap 52, seating between it and the extreme lower end edge of cylindrical element 27.

An O-ring 55 is disposed below the peripheral edge of gasket 54 to insure against leakage along the threads between elements 27 and 53. Another sealing O-ring, number 56, is provided adjacent piston rod 47 immediately beneath the inner edge of gasket 54, which inner edge surrounds a central gasket opening through which the piston rod 47 extends. Sealing O-ring 56 and its associated wall means form a sliding seal between bottom cap 52 and the piston rod 47.

The piston rod 47 is formed of metal, so there is a close but sliding fit between the piston rod and the cylindrical wall of the thick bottom portion of bottom cap 52. Such sliding fit, and the described assembly including O-ring 56, permit relatively low friction movement of the piston rod while effectively preventing leakage of liquid therepast.

Formed in the bottom cap 52 beneath gasket 54 is an annular groove 57, this being preferably concentric with the piston rod 47 as illustrated. Groove 57 communicates radially with a horizontal passage 58, the latter being associated with a fitting portion 59 for a pressure hose 60. Hose 60 curves upwardly to a nozzle 61 which is mounted in bottom wall 19 of the liquid container. Such nozzle has a radial port 62 directed horizontally along bottom container wall 19.

A port 63 provided in gasket 54 permits back-and-forth flow of liquid between the lower cylinder chamber 44 and annular groove 57, and thus via passage 58 and hose 60 with nozzle 61 and its port 62.

The size of port 62 is such that there is effective back-and-forth flow of liquid between chamber 12 in liquid container 10, and lower cylinder chamber 44, so as to achieve agitation of the fertilizer, insecticide, fungicide, etc., contained in the liquid container. This agitation is particularly effective when the contained liquid is one having powdered insecticide, etc., in suspension.

Proceeding next to a description of the main pumping action effected by double piston 37 in response to reciprocation of piston rod 47, it is pointed out that there are two passages between upper cylinder chamber 42 and portions of the apparatus that are above such chamber. One of these passages, number 64, extends through a portion 65 of the region of the pumping mechanism body that is above radial wall 28. Passage 64 communicates at its upper end with an inlet notch 66 which, in turn, communicates directly with the lower portion of liquid chamber 12. The other passage, numbered 67, extends upwardly from upper cylinder chamber 42 through pump portion 65 to the pressure chamber 35.

A flexible check-valve disc 68 is mounted below the lower end of passage 64, being held in a horizontal plane by a screw 69 that is threaded upwardly into pump portion 65. Similarly, a flexible disc 70 is disposed over the upper end of passage 67, having been pushed—at a central opening therein—downwardly over an integral knob 71 that forms part of element 65.

Disc 70 permits flow through passage 67 in only the upward direction from chamber 42, whereas disc 68 permits flow through passage 64 in only the downward direction from container chamber 12. Thus, upon each upward reciprocation of double piston 37, liquid from upper cylinder chamber 42 is forced through passage 67 and past valve disc 70 into pressure chamber 35, while no liquid passes upwardly through passage 64 since disc 68 prevents such flow. Conversely, upon each downward reciprocation of double piston 37 liquid is drawn downwardly from chamber 12 through notch 66 and passage 64 past disc 68 into the upper cylinder chamber 42. No liquid can flow downwardly from pressure vessel 35 due to the operation of disc 70.

The manually-operated actuating portion of the pumping and agitating apparatus comprises a horizontal shaft 72 that is mounted in bearings 73, the latter being integral with the synthetic resin supporting and mounting portion 15 of the apparatus. Shaft 72 suitably connects to a handle 75 adapted to be reciprocated by the operator with great mechanical advantage.

Two bellcranks 76,77 are fixedly mounted on shaft 72 on opposite sides of piston rod 47, and these pivotally connect to a short horizontal cross-member 78. Cross-member 78 extends through a horizontal slot 79 formed in a synthetic slide resin bearing element 80 that is fixed at the lower end of piston rod 47. Two spacer cylinders 81, preferably formed of brass, are seated on cross-member 78 between bellcranks 76,77. The relationship between cross-member 78 and slot 79 is such that reciprocating movement of piston rod 47 and of double piston 37 is achieved without any substantial tendency to bend the piston rod or create a binding action.

Summary

Upward and downward movement of handle 75 operates to reciprocate the double piston 37 vertically in upper cylinder chamber 42 and lower cylinder chamber 44, so that liquid is drawn from container chamber 12 into the upper cylinder chamber 42 and then is forced outwardly into pressure vessel 35. Simultaneously, as described above, liquid in the lower cylinder chamber 44 is forced downwardly through port 63 and thence through groove 57 and conduit 60 to nozzle port 62 so as to eject liquid into the bottom portion of chamber 12 for creation of agitation action.

Should there be any leakage of liquid from the upper cylinder chamber 42 to lower cylinder chamber 44, this does not create any hazard because such liquid is added to that which flows back and forth between the lower cylinder chamber 44 and container chamber 12.

A downwardly-extending tubular pressure-vessel portion 82 (FIG. 2) is connected to a spray tube 83 (FIG. 1) that is relatively long. Tube 83 has a wand and nozzle assembly 84 at the outer end thereof. A valve 85 is opened and closed by the operator to control the discharge of pressurized insecticide, fertilizer, fungicide, etc., from pressure vessel 21.

It is pointed out that the pumping mechanism is first operated to pressurize the fluid in pressure vessel 21, since upward flow of liquid from upper cylinder chamber 42 into the vessel 35 acts to compress air in the upper end of the pressure vessel 21 as well as filling the lower end of the pressure vessel with the liquid. Because of the high mechanical-advantage relationship which is present, the pressure of the air in the upper end of the pressure vessel becomes quite high. Accordingly, there is no need to operate the valve 85 (FIG. 1) simultaneously with operation of handle 75. Instead, the handle 75 may be operated periodically, following which the valve 85 is operated in conjunction with wand 84 to direct the liquid at the desired point of application.

The United States patents cited in this specification are hereby incorporated by reference herein.

The foregoing detailed description is to be clearly understood as given by way of illustration and example only, the spirit and scope of this invention being limited solely by the appended claims.

What is claimed is:

1. Apparatus for applying insecticides, fertilizers, and other liquids to crops and the like, which comprises:

(a) a large liquid-container tank adapted to be carried on the back of an operator,
 said container tank having a fill opening therein and an associated fill-opening cover,
 said container tank having a bottom interior portion and also having a lower portion, (b) a pressure vessel mounted within said container tank,
 said pressure vessel having a bottom portion extending downwardly to a bottom wall of said container tank,
 said bottom portion of said pressure vessel being sealingly associated with said bottom wall of said container tank, (c) a pumping assembly associated with said bottom portion of said pressure vessel and also with said bottom interior portion of said container tank,
 said pumping assembly comprising wall means to define a cylinder chamber,
 said pumping assembly further comprising a double-acting piston assembly mounted slidably in said cylinder chamber for reciprocation therein longitudinally thereof,
 said pumping assembly further comprising valve and passage means to connect the portion of said cylinder chamber above said piston assembly to said pressure vessel and to said container tank, in such manner that upon reciprocation of said piston assembly said piston assembly pumps liquid from said container tank to said pressure vessel,
 said pumping assembly further comprising means to connect the portion of said cylinder chamber below said piston assembly to said lower portion of said container tank, in such manner that upon reciprocation of said piston assembly said piston assembly pumps said liquid back and forth between said lower portion of said container tank and said portion of said cylinder chamber below said piton assembly, (d) means, including an operator-actuated handle, to effect reciprocation of said piston assembly, and (e) hose and control-valve means to discharge a liquid from said pressure vessel for application onto crops,
 characterized in that there is no diaphragm associated with said pumping assembly, all pumping of said liquid being done by said above-recited pumping assembly, and further characterized in that any liquid which leaks between said piston assembly and said wall means of said cylinder chamber does not drop onto the operator or the earth but instead joins liquid being pumped back and forth between the lower portion of said container tank and the portion of said cylinder chamber beneath said double-acting piston.

2. The invention as claimed in claim 1, in which said wall means to define a cylinder chamber includes a bottom cap mounted sealingly below said piston assembly, said bottom cap having a bottom wall that has a bore therethrough, in which said means to effect reciprocation of said piston assembly includes a piston rod mounted slidably in said bore and connected to said piston assembly, further includes a slotted bearing element connected to said piston rod, further includes a cross-member mounted in the slot in said slotted bearing element, further includes bellcrank means connected to said cross-member, and further includes a shaft connected to said bellcrank means and to said operator-actuated handle.

3. The invention as claimed in claim 1, in which said wall means to define a cylinder chamber includes a bottom cap mounted sealingly below said piston assembly, said bottom cap having a bottom wall that has a bore therethrough, in which said means to effect reciprocation of said piston assembly includes a piston rod mounted slidably in said bore and connected to said piston assembly, in which a gasket is mounted in said bottom cap on said bottom wall thereof, around said piston rod, in which a groove is formed in said bottom wall and is closed by said gasket, in which said gasket has a port therein permitting flow between said groove and a region of said cap above said gasket, said latter region being open to the bottom side of said piston assembly, and in which conduit means are provided to connect said groove to said lower portion of said container tank, said conduit means and said groove and said port forming parts of said means to connect the portion of said cylinder chamber below said piston assembly to said lower portion of said container tank.

4. The invention as claimed in claim 1, in which said wall means to define a cylinder chamber includes a bottom cap mounted sealingly below said piston assembly, said bottom cap having a bottom wall that has a bore therethrough, in which said means to effect reciprocation of said piston assembly includes a piston rod mounted slidably in said bore and connected to said piston assembly, in which a gasket is mounted in said bottom cap on said bottom wall thereof, around said piston rod, in which a groove is formed in said bottom wall below said gasket, in which said gasket has a port therein permitting flow between said groove and a region of said cap above said gasket, said latter region being open to the bottom side of said piston assembly, in which conduit means are provided to connect said groove to said lower portion of said container tank, said conduit means and said groove and said port forming parts of said means to connect the portion of said cylinder chamber below said piston assembly to said lower portion of said container tank, and in which said means to effect reciprocation of said piston assembly further includes a slotted bearing element connected to said piston rod, further includes a cross-member mounted in the slot in said slotted bearing element, further includes bellcrank means connected pivotally to said cross-member, and further includes a shaft connected to said bellcrank means and to said operator-actuated handle.

5. The invention as claimed in claim 1, in which said means to effect reciprocation of said piston assembly includes a piston rod connected to said piston assembly, further includes a slotted bearing element connected to said piston rod, further includes a cross-member mounted in the slot in said slotted bearing element, further includes bellcrank means connected pivotally to said cross-member, and further includes a shaft connected to said bellcrank means and to said operator-actuated handle.

6. The invention as claimed in claim 1, in which said piston assembly comprises back-to-back resilient cups, one of said resilient cups being the upper cup, the other of said resilient cups being the lower cup, said upper cup having an edge which seals against said wall means and defines the lower part of an upper cylinder chamber, said lower cup having an edge which seals against said wall means and defines the upper part of a lower cylinder chamber.

7. The invention as claimed in claim 6, in which said piston assembly further comprises a flange centering member seated on and in said cups, and a flange cup that is itself telescoped over said centering member.

8. The invention as claimed in claim 7, in which said flange cup has a flange that engages and supports said lower cup, and in which said centering member has a flange that has less radial dimension than said upper flange of said flange cup, and is engaged with the upper side of said upper cup.

9. Apparatus for applying insecticides, fertilizers, fungicides and other liquids to crops, which comprises:

(a) a large liquid container tank formed of synthetic resin and adapted to be carried on the back of an operator, said container tank having a lower side and also having an upper wall, said container tank having a synthetic resin frame and mounting portion provided on said lower side thereof, said container tank having a fill opening therein in said upper wall thereof, and having an associated fill-opening cap, (b) a synthetic resin pressure vessel mounted within said container tank, said pressure vessel having a bottom portion extending downwardly to a bottom wall of said container tank, said bottom portion of said pressure vessel being sealingly associated with said bottom wall of said container tank, (c) a manually-operated pumping assembly associated with said bottom portion of said pressure vessel, said pumping assembly comprising synthetic-resin wall means to define a cylinder chamber, said pumping assembly further comprising a piston assembly mounted slidably in said cylinder chamber for reciprocation therein longitudinally thereof, said pumping assembly further comprising valve and passage means to connect the portion of said cylinder chamber above said piston assembly to said pressure vessel and to said container tank, in such manner that upon reciprocation of said piston assembly said piston assembly pumps liquid from said container tank to said pressure vessel, (d) bottom cap means forming part of said wall means to define said cylinder chamber, said bottom cap means being mounted coaxially relative to the side wall of said cylinder chamber, said bottom cap means having a central cylindrical passage therethrough, (e) means, including an operator-actuated handle, to effect reciprocation of said piston assembly, said reciprocation means comprising a piston rod that extends slidably through said cylindrical passage in said bottom cap means, said reciprocation means further comprising a slotted slide bearing mounted at the lower end of said piston rod, said reciprocation means further comprising a cross-member extended slidably through the slot in said slide bearing, said reciprocation means further comprising bell-crank means connected pivotally at one end to said cross-member and at the other end fixedly to a rotatable horizontal shaft, and (f) hose and control-valve means to discharge liquid from said pressure vessel for application onto crops.

* * * * *